United States Patent [19]

Baba et al.

[11] 4,365,396

[45] Dec. 28, 1982

[54] METHOD FOR MANUFACTURING A BASELESS INCANDESCENT LAMP ASSEMBLY

[75] Inventors: Masaharu Baba, Yokohama; Kiyokazu Honda, Zushi; Akiyoshi Hashima, Yokohama, all of Japan

[73] Assignee: Tokyo Shibaura Denki Kabushiki Kaisha, Kawasaki, Japan

[21] Appl. No.: 213,077

[22] Filed: Dec. 4, 1980

[30] Foreign Application Priority Data

Dec. 20, 1979 [JP] Japan ..... 54-165986

[51] Int. Cl.[3] ..... H01R 33/06; H01K 3/06

[52] U.S. Cl. ..... 29/25.13; 29/509; 29/854; 29/844; 29/882; 339/176 L

[58] Field of Search ..... 29/25.13, 417, 844, 29/854, 881, 882, 883, 509; 339/276 SF, 176 L, 218 R, 218 L; 264/249

[56] References Cited

U.S. PATENT DOCUMENTS

| | | | |
|---|---|---|---|
| 3,253,249 | 5/1966 | Hess et al. | 339/176 L X |
| 4,181,390 | 1/1980 | Aizawa | 339/176 L X |
| 4,193,181 | 3/1980 | Boulanger | 29/509 |

*Primary Examiner*—Kenneth J. Ramsey

*Attorney, Agent, or Firm*—Cushman, Darby & Cushman

[57] ABSTRACT

A method for manufacturing a baseless incandescent lamp assembly comprises a step for holding a flattened seal section of a baseless incandescent lamp between a pair of holding members, a step for inserting the holding members into a lamp holding chamber of a main socket body while keeping the flattened seal action of the baseless incandescent lamp between the holding members, and a step for softening part of said main socket body by heating to deform the same, thereby forming caulked portions to prevent the inserted holding members from slipping out of the lamp holding chamber.

10 Claims, 14 Drawing Figures

METHOD FOR MANUFACTURING A BASELESS INCANDESCENT LAMP ASSEMBLY

This invention relates to a method for manufacturing a baseless incandescent lamp assembly consisting of a baseless incandescent lamp and a socket to hold the lamp.

Baseless incandescent lamps are generally used as illuminating light sources for dashboards of vehicles, and are available in combination with sockets for exclusive use. Such a socket has a lamp holding chamber in which the flattened seal section of a baseless incandescent lamp is inserted and a holding member formed by bending a metal plate which is previously fixed in the lamp holding chamber, and is so designed as to be able to be mounted on a printing substrate on the back side of a dashboard. The baseless incandescent lamp is fixedly held in the socket when it is inserted in the lamp holding chamber to have its flattened seal section pinched by the holding member. The external lead wires of the baseless incandescent lamp, extending along the outside surface of the flattened seal section, are held between and pressed by the flattened seal section and the holding member to be in electrical contact with the holding member. As a result, the baseless incandescent lamp held in the socket is supplied with electric power through the holding member.

In the combination of the baseless incandescent lamp and the socket of the aforementioned construction, however, the external lead wires are liable to slip off the outside surface of the flattened seal section, and often fail to be securely held between the holding member and the flattened seal section, thereby causing defective electrical contact.

Since the baseless incandescent lamp of this type, in use, is mounted on the back side of a dashboard, as mentioned above, so that it requires a great deal of labor to replace a defective baseless incandescent lamp assembly with new one.

Moreover, such prior art baseless incandescent lamp assembly is not suited for mass production because it requires troublesome manufacturing operations; it is necessary that holding members be inserted and fixed one by one in the lamp holding chambers of holders to form sockets, and that baseless incandescent lamps be fitted in these sockets one at a time.

Accordingly, the object of this invention is to provide a method for manufacturing a baseless incandescent lamp which is not liable to defective electrical contact and is adapted for mass production, requiring only easy manufacturing operations.

Figure 1:
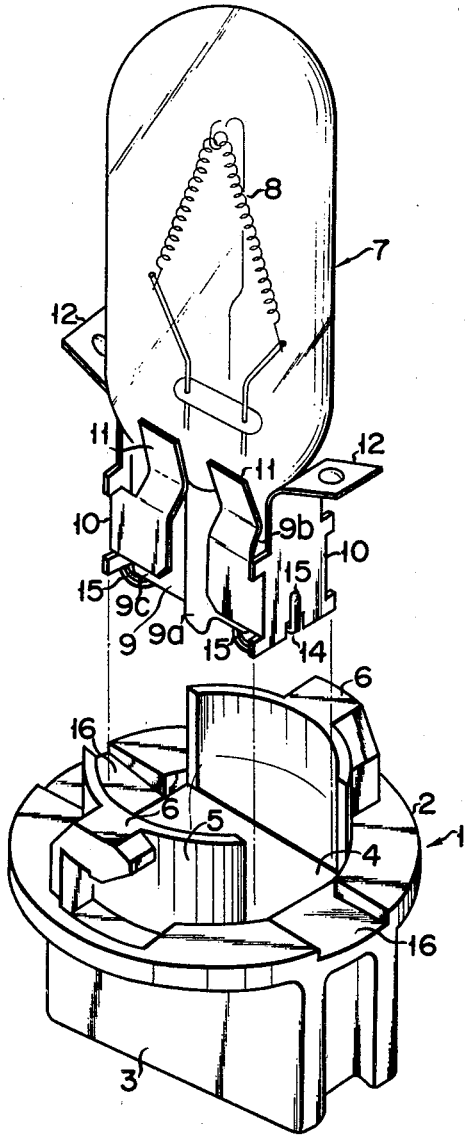
Figure 2:
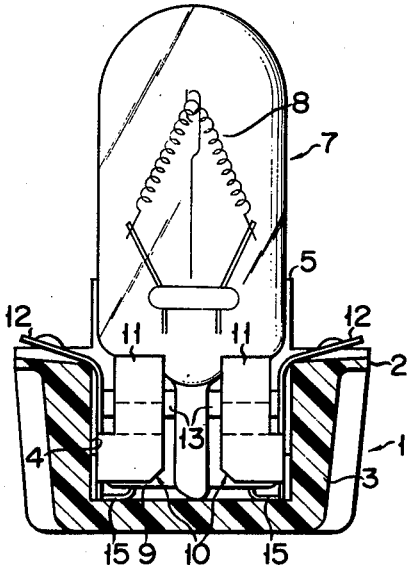
Figure 3:
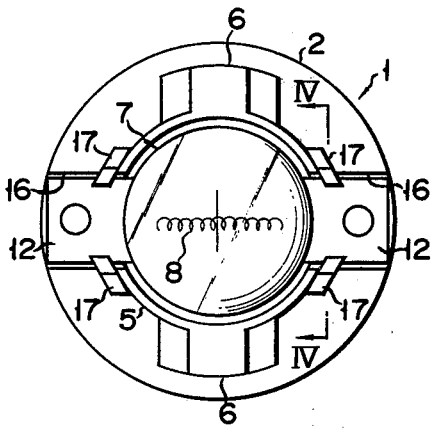
Figure 4:
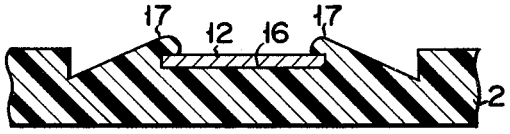
Figure 5:
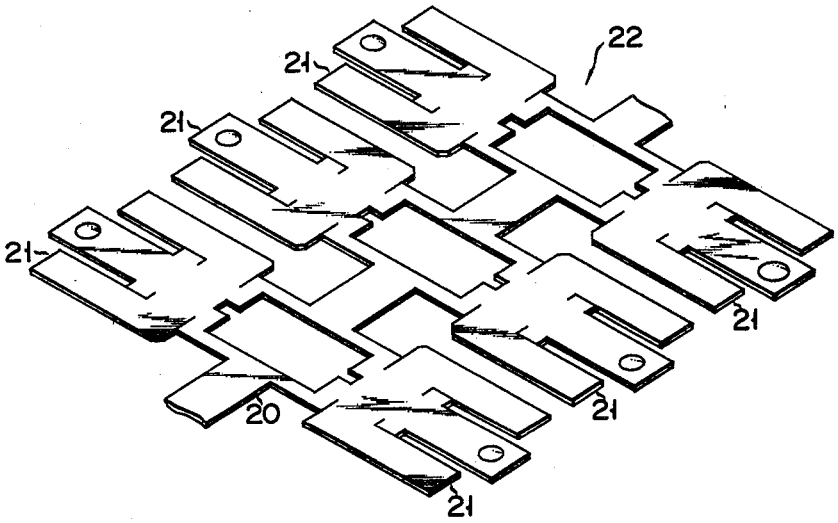
Figure 6:
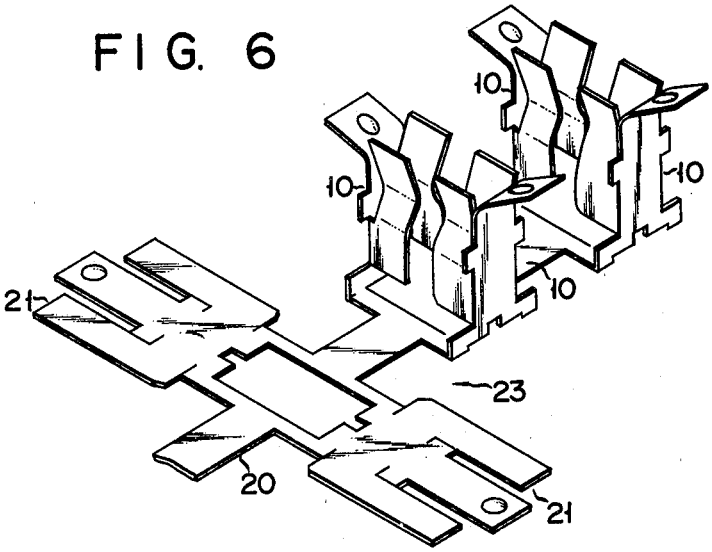
Figure 7:
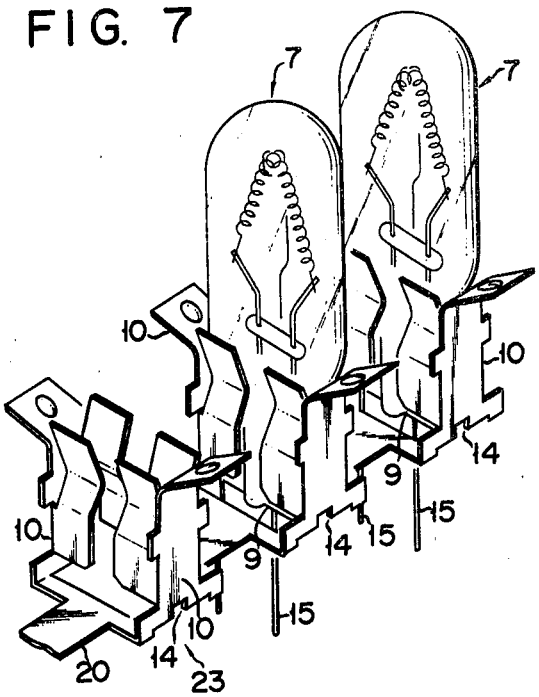
Figure 8:
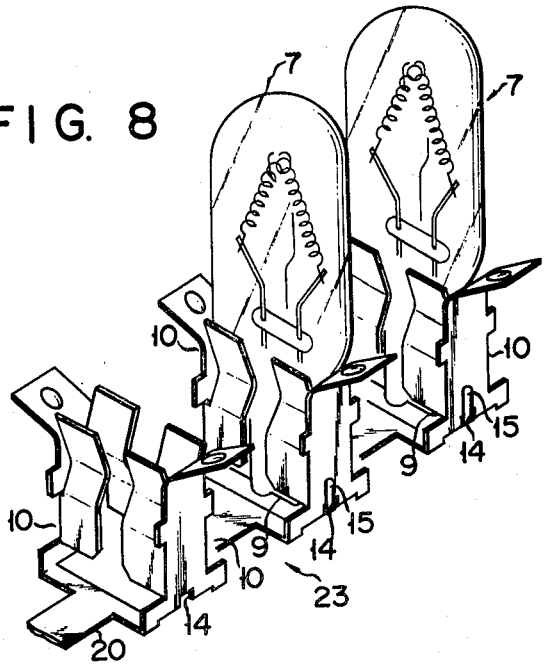
Figure 9:
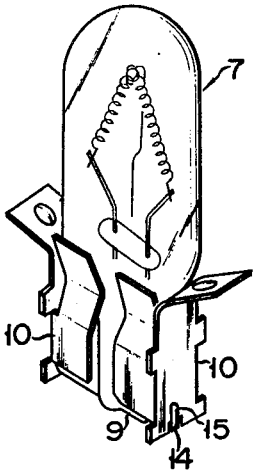
Figure 10:
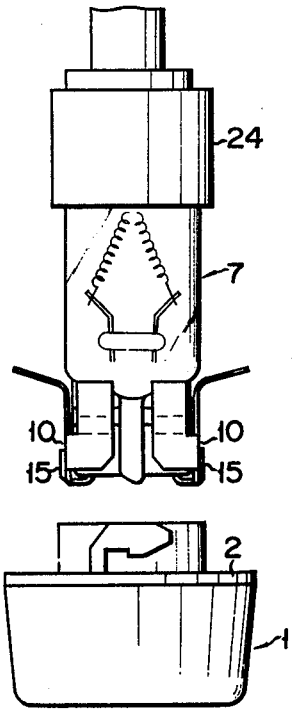
Figure 11:
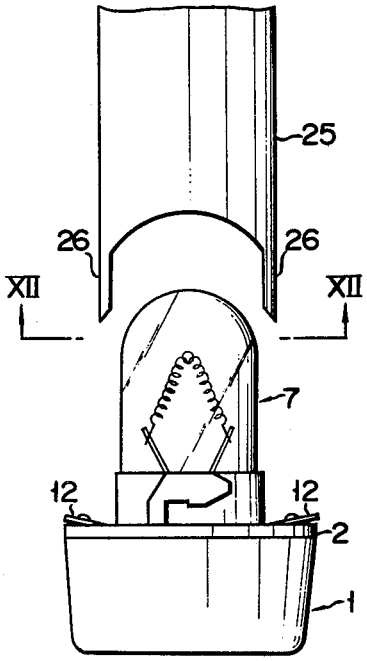
Figure 12:
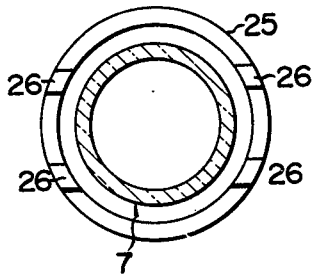
Figure 13:
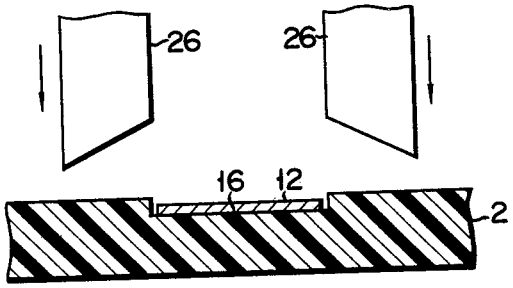
Figure 14:
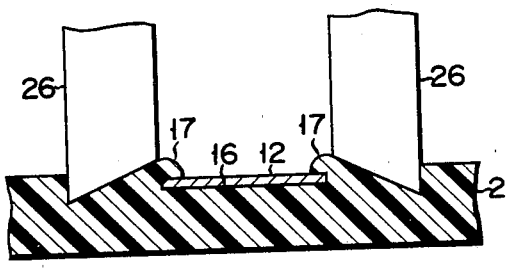

This invention can be more fully understood from the following detailed description when taken in conjunction with the accompanying drawings, in which:

FIGS. 1 to 4 show a baseless incandescent lamp assembly manufactured by a manufacturing method according to an embodiment of this invention, in which FIG. 1 is a disassembled perspective view, FIG. 2 is a longitudinal sectional view, FIG. 3 is a plan view, and FIG. 4 is a sectional view as taken along line IV—IV of FIG. 3;

FIGS. 5 to 12 are schedule diagrams for illustrating the manufacturing method according to an embodiment of the invention, in which FIG. 5 is a perspective view of an intermediate product to form holding members, FIG. 6 is a perspective view of a continuous holding member chain formed of the intermediate product of FIG. 5, FIG. 7 is a perspective view showing baseless incandescent lamps held by the continuous chain of FIG. 6, FIG. 8 is a perspective view showing the baseless incandescent lamps of FIG. 7 with their external lead wires trained along the outside faces of their corresponding holding members, FIG. 9 is a perspective view of a pair of holding members cut off from the continuous chain, FIG. 10 is a front view for illustrating the way of inserting the baseless incandescent lamp with the holding members into a main socket body, FIG. 11 is a front view of the lamp socket holding the baseless incandescent lamp which is subjected to heat treatment, and FIG. 12 is a sectional view as taken along line XII—XII of FIG. 11; and FIGS. 13 and 14 are sectional views successively showing the way of the heat treatment.

Now there will be described a method for manufacturing a baseless incandescent lamp according to an embodiment of this invention with reference to the accompanying drawings.

Referring first to FIGS. 1 to 4, the construction of the baseless incandescent lamp to be manufactured will be described to facilitate the understanding of the invention.

In these figures, numeral 1 designates a main body of a lamp socket. The main lamp socket body 1, which is formed by integrally molding thermoplastic synthetic resin, includes a circular flange section 2 and a knob section 3 on the back side of the flange section 2. Defined in the main socket body 1 is a lamp holding chamber 4 opening in the front of the flange section 2. The lamp holding chamber 4 is substantially in the form of a rectangle defined by wide front and rear sides and narrow lateral sides. A pair of fitting edge sections 5 protrude from the front of the flange section 2, located around the opening of the lamp holding chamber 4. These fitting edge sections 5 each have an inside face with such radius of curvature that they may engage the front and rear sides of the bulb of a baseless incandescent lamp held in the socket body, thereby preventing the bulb from wobbling. Severally from the outside faces of the fitting edge sections 5 protrude stopping projections 6 spaced at a given distance from the front face of the flange section 2. When the main socket body 1 is inserted and turned in a mounting hole in a printed substrate (not shown), the mounting hole edge of the printed substrate is held between the flange section 2 and the stopping projections 6 so that the socket may be mounted on the printed substrate.

Numeral 7 designates a baseless incandescent lamp which has a flattened seal section 9 formed by flattening the bottom portion of a cylindrical bulb and a filament 8 contained in the bulb. The flattened seal section 9 of the baseless incandescent lamp 7 is divided into left and right portions **9*b* and 9*c* by an exhaust tube 9*a*. Holding members 10 are attached severally to the left and right portions 9*b* and 9*c*. These holding members 10 are formed by pressing a brass plate, each having a facing pair of pinch strips 11 and a contact strip 12 which is bent substantially at right angles to the pinch strips and stretched therebetween to couple the same. The pinch strips 11 have at their middle portions their respective pinch sections inwardly bent so as to approach each other. Thus, the baseless incandescent lamp 7 inserted between these pinch strips 11 has the left and right portions 9***b* and 9*c* of its flattened seal section 9 held severally between the pinch sections of the two pinch strips 11 by the spring action thereof. To ensure such holding, engaging grooves 13 are formed respectively at the basal parts of the front and rear sides of the flattened seal section 9 so that the pinch sections of the pinch strips 11 may be fitted in the grooves 13. The holding members 10 have a common open bottom side, and a lead wire notch 14 extends upward from the bottom end of each contact strip 12. A pair of external lead wires 15 of the baseless incandescent lamp 7 have their one ends electrically connected with the filament 8 and the other ends passing through the left and right seal portions 9*b* and 9*c* and extended from the bottom ends thereof to the outside. The outwardly extended external lead wires 15 are doubled and bent respectively toward both flanks of the baseless incandescent lamp 7. The tip end of each doubled lead wire 15 is bent upward at a point where it outwardly passes through the notch 14 of its corresponding contact strip 12, and extends along the outside face of the contact strip 12. Hereupon, the contact strip 12 may be in contact with or kept apart from the bent tip end portion of the doubled lead wire 15. The flattened seal portion 9 of the baseless incandescent lamp 7 and the pair of holding members 10 pinching the flattened sealing section 9 therebetween are inserted in the lamp holding chamber 4 of the main socket body 1. The dimensions of the lamp holding chamber 4 are such that no substantial gap may be left between the outer peripheral surfaces of the paired holding members 10 holding the flattened seal section 9 and the inner peripheral surface of the holding chamber 4. Namely, the width of the holding chamber 4 is a little greater than the distance between the respective contact strips 12 of the two holding members 10, and the depth of the chamber 4 is a little greater than the distance between the pinch strips 11 of each holding member 10. As a result, the end portion of each external lead wire 15 extending along the outside face of the contact strip 12 of its corresponding holding member 10 inserted in the lamp holding chamber 4 is held between the outside face of the contact strip 12 and the inside wall of the holding chamber 4, so that the electrical contact between the end portion of the lead wire 15 and the holding member 10 is secured.

The top portions of the contact strips 12 are bent so as to be severally fitted in a pair of grooves 16 which are formed in the front of the flange section 2 of the main socket body 1, extending in the radial direction of the flange section 2. The top end portions of the contact strips 12 are projected a little ahead of the front of the flange section 2 so that they may elastically abut against power supply terminals of the printed substrate to be supplied with power when the main socket body 1 is mounted on the printed substrate. Respectively formed on both sides of the basal parts of the grooves 16 are caulked portions 17 which project on both side edges of the contact strips 12 to prevent the holding members 10 from slipping off the socket body.

Referring now to FIGS. 5 to 14, there will be described a method for manufacturing the baseless incandescent lamp of the aforementioned construction according to an embodiment of the invention.

As shown in FIG. 5, a plate of conductive material such as a brass plate is stamped out to form an intermediate product 22 which includes a number of facing pairs of developed holding member sections 21 on both sides of a belt-like coupling section 20. Each developed section 21 has a shape corresponding to the developed configuration of the aforementioned holding member, having a contact strip and a pair of pinch strips located on both sides thereof across slits. These strips are coupled with one another at their basal parts and connected to the coupling section 20. Then, as shown in FIG. 6, the contact strip and the pinch strips are bent upward at an angle of 90° at their coupled basal parts, and the pinch strips are further bent inward at 90° at their corresponding slits to form one of the holding members 10. A structure including a number of pairs of such holding member 10 coupled on both sides of the coupling section 20 is referred to as a continuous holding member chain 23. Subsequently, as shown in FIG. 7, the flattened seal section 9 of the baseless incandescent lamp 7 is inserted into one of the facing pairs of holding members to be pinched thereby. At this time, the external lead wires 15 are left untrained or extended downward. As shown in FIG. 8, thereafter, the external lead wires 15 are doubled, and then bent sideways or toward their corresponding contact strips at their respective basal parts. Then, the tip end portions of the doubled lead wires 15 are outwardly extended from their corresponding notches 14, and the extended portions are bent upward along the outside faces of their corresponding contact strips. In this way, a single baseless incandescent lamp is mounted on a pair of holding members 10 facing each other across the coupling section 20. Thus, every pair of holding members are fitted with a baseless incandescent lamp by repeating such operation. The mounting of the baseless incandescent lamps may be performed all together or by a desired number at a time. Then, as shown in FIG. 9, each pair of holding members 10 with the flattened seal portion 9 pinched therebetween is cut off from the coupling section 20 to separate the baseless incandescent lamps from one another. Subsequently, as shown in FIG. 10, the baseless incandescent lamp 7 with the holding members thereon is held by means of a vacuum chuck 24, and the flattened seal section 9, together with the holding members, is inserted into the lamp holding chamber 4 of the main socket body 1. Then, as shown in FIG. 11, an ultrasonic oscillator 25 is pressed against the front face of the flange section 2 of the main socket body 1 for ultrasonic heating. As shown in FIG. 12, the ultrasonic oscillator 25 has four projections 26 corresponding to both sides of the basal parts of the pair of grooves 16 of the flange section 2, the tip ends of these projections 26 being upwardly inclined toward the center lines of the grooves 16. In the ultrasonic heating, the inclined end portions of the projections 26 are pressed against both sides of the grooves 16 to heat and soften the same. Then, as the inclined end portions of the projections 26 are forced into the flange section 2, softened resin is pushed toward the grooves 16 to be projected onto the top of the contact strips 12, thereby forming the caulked portions 17, as shown in FIG. 14. The projected caulked portions 17 enable the holding members 10 to be fixedly held in the main socket body 1 are prevented from slipping off the socket body.

In the manufacturing method according to the aforementioned embodiment, the flattened seal section of the baseless incandescent lamp and the holding members are inserted into the lamp holding chamber of the main socket body after previously interposing the former between the latter, and finally part of the main socket body is softened by heating to form caulked portions or fixing portions, thereby preventing the holding members from slipping out of the lamp holding chamber. Thus, the operating efficiency is improved since a pair of holding members can be inserted into the lamp holding chamber of the main socket body simultaneously with the insertion of the baseless incandescent lamp without the trouble of separately inserting the pair of holding members, which are small-sized and complicated in configuration, into the lamp holding chamber. Further, the inserted holding members are securely fixed to the main socket body through deformation of the main socket body caused by local heating, so that the external lead wires will never move after connection to cause defective electrical contact. Naturally, the heat treatment may satisfactorily be conducted with ease by using such method as ultrasonic heating, high-frequency heating, or pressure contact of heated body. Such local heating is not limited to the flange section, and heat may also be applied to the inner peripheral surface defining the lamp holding chamber so that the holding members may be fixed thereat. The electrical connection between the external lead wires and the holding members is not limited to the case of the above embodiment in which it is obtained through the hold of the lead wires between the contact strips of the holding members and the inner peripheral walls of the main socket body, and such connection may also be obtained by holding the lead wires between the pinch strips and the inner peripheral walls, for example. Alternatively, the external lead wires and the holding members may be coupled by welding, brazing engagement or other means before inserting the holding members into the main socket body. Even the previous coupling by such other means will be easier than coupling with the socket.

Although in the above embodiment a number of baseless incandescent lamps are attached at a time to a number of pairs of holding members connected to a coupling section, the baseless incandescent lamps may also be attached to separated pairs of holding members. However, a higher operating efficiency may be obtained with the manner of the foregoing embodiment.

What we claim is:

1. A method for manufacturing a baseless incandescent lamp having a flattened seal section and external lead wires led outward from said flattened seal section; a main socket body having a lamp holding chamber to contain the flattened seal section of said baseless incandescent lamp; and a pair of conductive holding members disposed inside the lamp holding chamber of said main socket body to hold and pinch the flattened seal section of said baseless incandescent lamp and electrically connected with said external lead wires, said method comprising:

a step for holding the flattened seal section of said baseless incandescent lamp between said pair of holding members;

a step for inserting said holding members into the lamp holding chamber of said main socket body while keeping the flattened seal section of said baseless incandescent lamp held with said holding members; and a step for softening part of said main socket body by heating to deform the same, thereby forming fixing portions to prevent said inserted holding members from slipping out of said lamp holding chamber.

2. A method according to claim 1, wherein said holding step includes processes of interposing the flattened seal section of the baseless incandescent lamp between a pair of holding members connected with each other by means of a coupling section and separating said holding members from said coupling section.

3. A method according to claim 1, wherein each said holding member has a pair of elastic pinch strips facing each other and an elastic contact strip coupling said elastic pinch strips.

4. A method according to claim 3, wherein said holding step includes processes of interposing the flattened seal section of the baseless incandescent lamp between the pinch strips of said holding members, and bending the external lead wires of said interposed baseless incandescent lamp so that the tip end portions of said lead wires may extend severally along the outer peripheral surfaces of said holding members.

5. A method according to claim 4, wherein said process of bending said external lead wires is a process of bending said lead wires so that the tip end portions of said lead wires may extend severally along the outer peripheral surfaces of the respective contact strips of said paired holding members.

6. A method according to claim 5, wherein said step for forming said fixing portions is a process for softening those portions of said main socket body in the vicinity of said holding members by heating to form projections protruding over said holding members.

7. A method according to claim 6, wherein said projections protrude on both sides of each said contact strip.

8. A method according to claim 7, wherein said projections are formed on a flange section of said main socket body.

9. A method according to claim 6, wherein said heating for softening is performed by using an ultrasonic oscillator.

10. A method according to claim 9, wherein said ultrasonic oscillator has projected sections with inclined tip ends to be pressed into said main socket body.

* * * * *